United States Patent [19]

Grumelot et al.

[11] Patent Number: 5,048,556

[45] Date of Patent: Sep. 17, 1991

[54] TRANSOM-MOUNTED VALVE WITH REMOTE ACTUATOR

[75] Inventors: Albert L. Grumelot, St. Mary's, Ohio; William J. Mitchell, Clermont, Fla.

[73] Assignee: Master Concepts Inc., Orlando, Fla.

[21] Appl. No.: 536,797

[22] Filed: Jun. 12, 1990

[51] Int. Cl.[5] ..... B63B 13/00; F16K 31/46

[52] U.S. Cl. ..... 137/270; 251/263; 251/294; 114/197

[58] Field of Search ..... 251/263, 294; 137/269, 137/270; 114/197

[56] References Cited

U.S. PATENT DOCUMENTS

| | | | |
|---|---|---|---|
| 345,722 | 7/1886 | Pattison . | |
| 525,948 | 9/1884 | Dunton . | |
| 636,465 | 11/1899 | Sowle et al. . | |
| 722,322 | 3/1903 | Palm . | |
| 765,727 | 7/1904 | Dock . | |
| 1,055,060 | 3/1913 | Litle, Jr. . | |
| 1,133,288 | 3/1915 | Junggren . | |
| 1,270,760 | 6/1918 | Ibach . | |
| 1,470,102 | 10/1923 | Rahm . | |
| 1,709,039 | 4/1929 | Poirmeur . | |
| 1,771,122 | 7/1930 | Jay . | |
| 1,877,210 | 9/1932 | Von Kohler . | |
| 1,961,469 | 6/1934 | West | 251/263 X |
| 2,095,696 | 10/1937 | Hackel | 137/34 |
| 2,231,630 | 2/1941 | Laddon et al. | 137/21 |
| 2,271,785 | 2/1942 | Watkins | 284/17 |
| 2,450,315 | 9/1948 | Vetrano | 225/5 |
| 2,697,447 | 12/1954 | Troy | 251/263 X |
| 2,730,062 | 1/1956 | Mitchell | 114/185 |
| 2,888,897 | 6/1959 | Pribyl | 114/185 |
| 2,909,144 | 10/1959 | Baldwin | 114/185 |
| 3,004,511 | 10/1961 | Moeller | 114/185 |
| 3,155,067 | 11/1964 | Gillette | 114/185 |
| 3,207,472 | 9/1965 | Seltsam | 251/331 |
| 3,249,123 | 5/1966 | Berg | 137/625 |
| 3,400,683 | 9/1968 | Forest | 114/185 |
| 3,447,777 | 6/1969 | Carlson | 251/144 |
| 3,565,031 | 2/1971 | DePersia | 114/197 X |
| 3,871,483 | 3/1975 | Espinosa et al. | 184/1.5 |
| 3,927,860 | 12/1975 | Smith et al. | 251/299 |
| 4,298,183 | 11/1981 | Kawakami | 251/263 |
| 4,319,664 | 3/1982 | Price et al. | 184/1.5 |
| 4,338,689 | 7/1982 | Zieg | 4/378 |
| 4,340,006 | 7/1982 | Patriarca et al. | 114/197 |
| 4,448,391 | 5/1984 | Young | 251/263 |
| 4,572,411 | 2/1986 | Dreibelbis | 222/469 |
| 4,801,053 | 1/1989 | Kaster | 222/506 |

*Primary Examiner*—Alan Cohan

*Attorney, Agent, or Firm*—Nixon & Vanderhye

[57] ABSTRACT

The transom-mounted valve includes a valve sleeve disposed in the drain port of a boat transom and carrying a valve stem for axial movement. The valve stem includes a valve head movable with the stem between valve-open and valve-closed positions. A cap is releasably secured on the inboard end of the sleeve and mounts an actuating cable guide and anchor, as well as a cam pivotally carried by the cap and attachable to the movable portion of the actuating cable. The cam engages the valve stem. Upon rotation of the cam by linear movement of the actuator cable, the stem is moved against the bias of the spring from the valve-closed to the valve-open position with the spring bias closing the valve when the cam is moved to the valve-closed position.

21 Claims, 3 Drawing Sheets

TRANSOM-MOUNTED VALVE WITH REMOTE ACTUATOR

BACKGROUND AND SUMMARY OF THE INVENTION

The present invention relates to valves for selectively opening and closing fluid ports and particularly relates to remotely-operated cam-actuated valves mounted to the transom of a boat and useful for draining the bilge of the boat.

In many types of boats, for example, ski boats with inboard engines, the drain for the bilge is located directly below the engine. To access the bilge and open the drain, it is often necessary to remove equipment, such as water skis, stacked on the boat deck and/or on the engine cover. It is also necessary for an individual to raise the engine housing cover and get down on his hands and knees to reach the handle, which is conventionally screwed into a drain port at the bottom of the bilge. Not infrequently, the handle cannot be turned because of the awkward angle and the lack of available leverage. Thus, to drain the bilge is awkward at best and may also be hazardous if the engine remains hot. Because of that substantial inconvenience and hazard, not infrequently the drain plugs in bilges are left in place at all times. Another common place for the drain in a boat is on the lower transom. When the vessel is running, the water trapped inside goes to the lowest point adjacent the drain in the transom. When two or more people are in the boat, one can pull the plug while the other drives. In this manner, the boat can be completely drained. This is, however, very dangerous because the vessel is under power and usually results in the individuals and boat becoming greasy and wet. In larger boats or boats with larger engines, it can be impossible. Not infrequently, boats are hung on davits each time service is performed to have the boat drained. This is usually done by suspending the boat downward by a forklift and is a costly procedure.

In a companion application Ser. No. 07/536,789, filed June 12, 1990, there is provided a remotely-operated linear-actuated valve located directly below the engine which solves the foregoing-noted problems associated with boats of that type. However, in other types of boats, it is often more convenient to mount the bilge drain valve in the transom rather than through the bottom of the hull. While such linear-actuated valve may be used in the transom, a different type of remotely-operated cam-actuated valve is preferred for those applications where the drain port is preferably located in the transom.

In order to provide an efficient remotely-operated cam-actuated valve in the transom, certain design criteria must be met. For example, it is common to employ a control cable, such as a bowden cable, connected to a control station, for example, a dash on a boat, whereby the valve may be actuated by a push-pull actuator at the control station. Thus, the cam operation must be responsive to a linear push-pull arrangement. Additionally, the routing of the cable from the remote control station to the valve oftentimes requires a particular orientation of the cam-actuated valve. For example, the linear movement of the actuator cable may be in line with the valve mechanism or at right angles to the valve mechanism, depending upon the particular boat design and the routing of the control cable. Thus, it is desirable to provide a valve which is readily adaptable for different orientations of the actuating cable direction. Also, to effectively drain the bilge, the valve must be located directly adjacent the bottom of the hull. This limits the space in which the valve operation may occur and imposes an additional design constraint.

Accordingly, the present invention provides a novel and improved remotely-operated cam-actuated valve, particularly useful for mounting in a drain port through the transom of a boat and which may accommodate the design features noted above. For example, the cam operation desirably should be reversible to accommodate either in-line or normal-to-in-line linear movement of the control cable for valve operation. The present valve thus affords this versatility, as well as easy installation, as will be apparent from the ensuing description.

In a preferred embodiment of the present invention, the cam-actuated valve hereof comprises a valve body in the form of an elongated sleeve which is preferably externally threaded at one end for threaded engagement with an internally threaded fitting secured to the outside surface of the transom of a boat. Thus, the sleeve projects from the fitting through the drain port opening in the transom and into the boat lying closely adjacent the hull bottom. The sleeve has a plurality of openings whereby water in the bilge of the boat may enter the valve sleeve for drainage, in a manner to be described. A valve stem is provided in the sleeve for axial movement and includes a valve head carrying a seal for engagement with a valve seat at the end of the sleeve adjacent the outer surface of the transom. The valve stem extends substantially coextensively within the sleeve and a spring cooperates between abutments on the stem and the sleeve to bias the stem into a valve-closed position. Because the stem is necessarily smaller in diameter than the sleeve to accommodate passage of water through the sleeve in the valve-open condition, it is important and necessary to center the valve stem relative to the sleeve. To accomplish this, a plurality of vanes are carried either on the sleeve or the stem and which vanes project radially to engage the other of the sleeve and the stem and hence center the stem within the sleeve.

A cap is provided on the inboard end of the sleeve and carries a cam actuator for the valve in a manner which permits ready reconfiguration of the valve for in-line or normal-to-in-line linear actuation of the cam. The cap includes a head having a slot therethrough. In the slot, there is provided a guide which serves as the anchor for the fixed part of the actuating cable and also as a guide for the cam which operates the valve. Particularly, the guide includes a pair of side plates spaced one from the other and located in the slot. Between the guide plates, the cam is pivotally mounted on a pin which extends through the cam, guide plates and the head of the cap. The cam engages the end of the valve member remote from the valve head and has high and low camming surfaces. Because the spring biases the valve stem toward the cam, the end of the valve stem acts as a cam follower against those camming surfaces. This enables the valve stem to be moved axially between valve-open and valve-closed positions, depending upon the pivotal position of the cam. The cam also includes an arm for connection with the movable cable of the actuating cable, it being appreciated that the non-movable part of the actuating cable is anchored to the guide. The cam is thus pivoted by a substantially linear movement of the movable cable through a range of movement approximately 90° to displace the valve stem axially between valve-open and valve-closed positions.

The cap, including the cam and guide, is releasably mounted on the end of the valve sleeve, enabling the cam and guide to be removed and reoriented, depending upon the orientation of the linear movement necessary to operate the valve. For example, the cam may be actuated by linear movement of the actuating cable in a direction substantially normal to the axial direction of the movement of the valve stem. Thus, the actuating cable is connected to the cam in a direction generally parallel to the transom. In order to reorient the cam for in-line movement of the valve stem, i.e., a linear movement of the actuating cable in a direction generally parallel to the axial movement of the valve stem and normal to the transom, the cap is first removed from the sleeve. Upon its removal and removal of the pin mounting the cam in the guide, the cam is reversed in position in the guide. Additionally, when the guide and cam are remounted in the slot on the cap, the guide is reoriented 90° from its previous position. Upon assembly of the cap onto the sleeve, the arm of the cam projects to one side of the valve throughout its full range of movement. This enables linear movement of the actuating cable in a direction generally parallel to the direction of movement of the valve stem. Thus, a valve is provided for mounting in the transom which is versatile and easy to install, as well as capable of accommodating different cable routings in various boats.

Various configurations of the openings in the valve sleeve may be provided according to the present invention. For example, in a preferred embodiment, the openings comprise elongated slots disposed at circumferentially spaced positions about the sleeve. Alternatively; a series of both axially and circumferentially spaced openings may be provided or a series of slots may be formed extending partway about the circumference of the sleeve, either in a radial plane or diagonally of the axis.

Additionally, the valve may be mounted in an opening in the transom without the need for a fitting. To accomplish this, the sleeve is externally threaded and is provided with a flange at its distal end. A nut may be threaded up on the interior of the transom to secure the valve sleeve to the transom.

In a preferred embodiment according to the present invention, there is provided a boat having a hull with a port through the hull, and a valve carried by the boat providing for selective fluid communication through the port, the valve including a valve sleeve having an axis and a valve seat, a valve head for sealing engagement with the seat and a stem projecting from the valve head within the valve sleeve. Means cooperable between the valve stem and the valve sleeve are provided for biasing the valve stem in a direction urging the valve head into a valve-closed position, with the valve head in sealing engagement with the valve seat. A mounting member is secured on the valve sleeve at an end thereof remote from the seat, the member having a centrally located slot. A cam is carried by the member in the slot for pivotal movement and has camming surfaces and an actuating arm, the member having an opening through its inner end, enabling engagement of the camming surfaces with the end of the stem remote from the member. Means are provided for pivoting the cam between valve-open and valve-closed positions, including an actuator connected to the arm and movable in a substantially linear direction. Finally, means are provided for releasably securing the cam relative to the member in either of two positions, the cam in a first position thereof being secured to the member for pivotal movement between valve-open and valve-closed positions in response to linear movement of the actuator in a direction generally parallel to the axis of the sleeve, the cam in a second position thereof being mounted for pivotal movement between valve-open and valve-closed positions in response to linear movement of the actuator in a direction generally normal to the axis of the sleeve.

In a further preferred embodiment according to the present invention, there is provided a boat having a transom, a valve providing for fluid communication through the transom, including a valve sleeve having an axis and a valve seat, a valve including a head for sealing engagement with the seat and a stem projecting from the head and within the valve sleeve, together with means cooperable between the valve stem and the valve sleeve for biasing the valve stem in a direction urging the valve head into a valve-closed position, with the head in sealing engagement with the valve seat. A cap is secured on the valve sleeve adjacent an end thereof remote from the seat. A cam is carried by the cap for pivotal movement and is engageable with the end of the stem remote from the head, the cam having a cam surface and being pivotal into a first position to displace the stem against the bias of the biasing means into a valve-open position, with the valve head disengaged from the seat. A plurality of radially extending projections are carried on one of the interior surfaces of the sleeve or the stem and engageable with the other of the interior sleeve surfaces or the stem to maintain the stem substantially centered within the sleeve during operation.

Accordingly, it is a primary object of the present invention to provide a novel and improved remotely-operated cam-actuated valve for mounting in the transom of a boat and which has a structure capable of reorienting its actuating cam to accommodate linear actuation thereof in multiple directions, as well as other features, such as low cost, ready and easy installation and virtually no maintenance.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
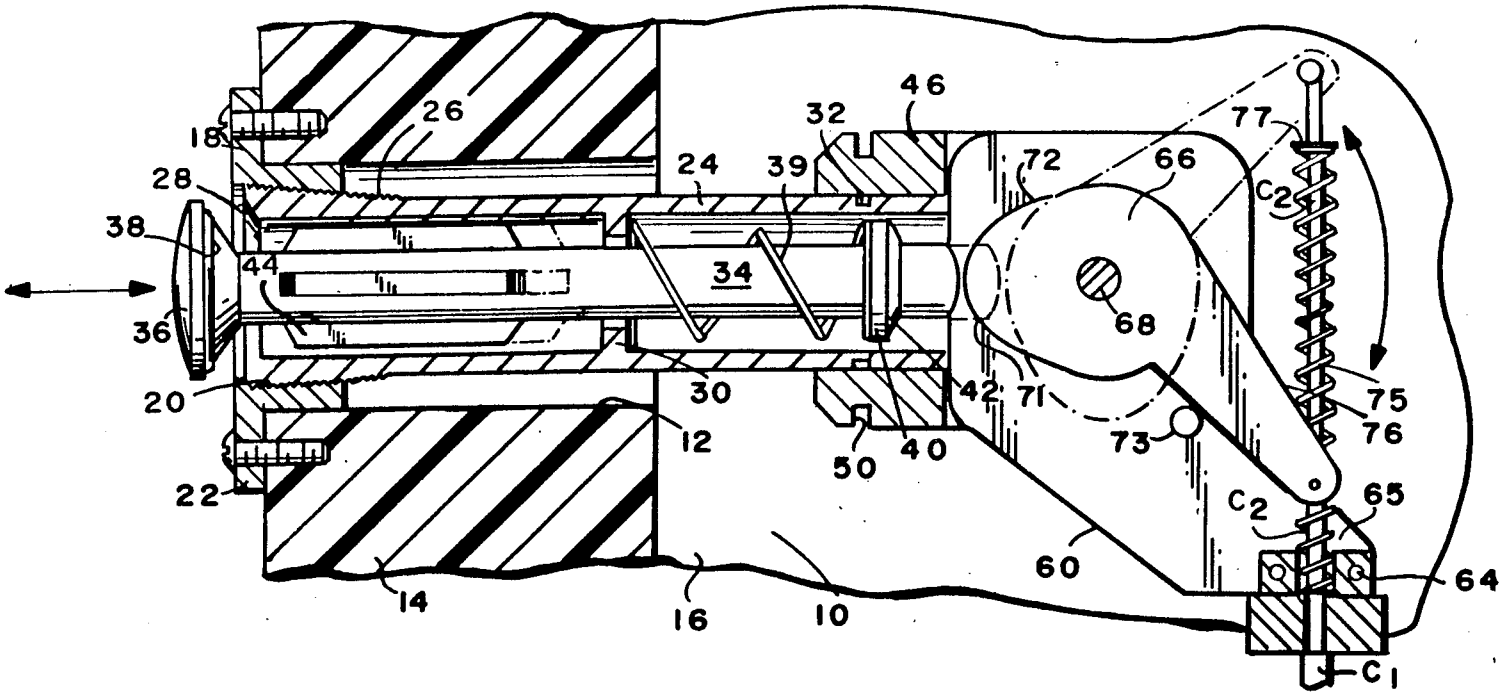
FIG. 1 is a plan view of a transom-mounted valve constructed in accordance with the present invention.

Referring now to the drawings, particularly to FIG. 1, there is illustrated a remotely-operated cam-actuated valve constructed in accordance with the present invention and generally designated 10. Valve 10 is mounted in the drain port 12 of the transom 14 of a boat, not shown, having a boat bottom 16. Drain port opening 12 is provided with a fitting 18 which includes an internally threaded opening 20 and flanges 22 for mounting, preferably by screws, fitting 18 to transom 14.

Valve 10 includes a valve body 24 comprised of an elongated sleeve having a tapering, externally threaded, end portion 26 whereby the sleeve 24 may be inserted through fitting 18 from outside transom 14 and screw-threaded into opening 20. The end of sleeve 24 outwardly of transom 14 defines a generally frustoconical-shaped valve seat 28. Sleeve 24 is smaller in diameter than drain port 12 and includes a plurality of openings about its circumference, enabling communication of fluid, for example, water in the bilge of the boat, to enter sleeve 24 for egress through the end of sleeve 24 outboard of transom 14. Various configurations of openings are illustrated in FIGS. 4–7, to be described. Sleeve 24 also includes a radially inwardly directed rib 30 substantially medially of its length and also has a radially outwardly opening groove 32 adjacent its distal inner end.

An elongated valve stem 34 is disposed within sleeve 24 for axial movement therein between valve-open and valve-closed positions. Valve stem 34 mounts a valve head 36 at its outer end, head 36 including a seal, for example, an 0-ring seal 38, for engagement with valve seat 28 in the valve-closed position. When assembling the valve, the valve stem 34 is inserted into sleeve 24 through its outboard end. A biasing means, for example, a helical spring 39, is disposed over the free end of stem 34, together with a washer 40 and friction washer 42. Thus, the opposite ends of the coil spring 39 bear against the rib 30 of sleeve 24 and the washer 40 on stem 34 whereby the stem is biased for axial movement into a valve-closed position, i.e., biased for movement from left to right, as illustrated in FIG. 1. Valve stem 34 also includes a plurality of centering vanes 44 spaced circumferentially one from the other thereabout which lie close to, but are spaced from, the interior surface of sleeve 24. The vanes may, of course, be mounted on the sleeve and project radially inwardly to guide the stem. The centering vanes 44 enable the valve stem 34 to move axially within sleeve 24 while retaining the stem substantially coaxial of the sleeve 24.

A cap 46 is provided for closing the inboard opposite end of valve sleeve 24. For reasons which will become apparent, cap 46 is releasably secured about sleeve 24 by a spring clip 48 (FIG. 2) which is received in grooves 50 of cap 46 and groove 32 of sleeve 24. Thus, spring clip 48 secures cap 46 about sleeve 24 and its removal from the grooves enables the cap to be removed axially from sleeve 24.

Cap 46 mounts the valve cam actuator. Particularly, and referring to FIG. 2, cap 46 includes a head on mounting member 52 having a central slot 54 opening laterally of head 52. Slot 54 terminates in an axial direction in an opening 56 for receiving the end of valve stem 34. Disposed within slot 54 is a guide 60 comprised of a pair of guide plates 62 spaced laterally one from the other. A pair of holes 64 are disposed in the distal end of plates 62 and mount a bracket 65 for anchoring the fixed cable C1 of the remote actuator cable, for example, a bowden-type cable having fixed and movable cable parts C1 and C2, respectively. Various spacers are used to maintain plates 62 spaced one from the other. Between plates 62 is mounted a cam 66, both the cam 66 and guide 60 being mounted on a pin 68 extending through an aperture in head 52. The pin may be removable by removing the cotter pin 70 at one end thereof. It will be appreciated that when the actuator is installed, the pin 68 lies on the axis of valve stem 64. Cam 66 is provided with high and low camming surfaces 71 and 72, respectively, which engage the distal end of valve stem 34 through axial opening 56. As best illustrated in FIG. 1, when cam 66 is mounted in the illustrated full-line position, the high cam surface 71 engages the distal end of valve stem 34 to space valve head 36 from valve seat 28 against the bias of spring 39. A cam stop 73 is provided between plates 62 to limit rotation of the cam 66 before it reaches the maximum displacement of the valve. A spring 75 surrounds the actuator cable C2 between bracket 65 and a cable anchor 77 to bias the cam to the valve closed position. Thus, both the cam stop 73 and spring 75 bias the valve to its closed position. When cam 66 is rotated to the dashed-line position, the bias of spring 39 enables the distal end of valve stem 34 to follow the cam surface on cam 66 such that low surface 72 engages that end in the valve-closed position. Cam 66 has a cam arm 76, the free end of which has an opening for connecting with the movable cable of the cable actuator. Consequently, it will be appreciated that by moving the movable cable in a direction generally normal to the axis of valve stem 34, cam 66 may be rotated between the illustrated full and dashed line positions and, hence, the valve moved between valve-open and closed positions.

Figure 2:
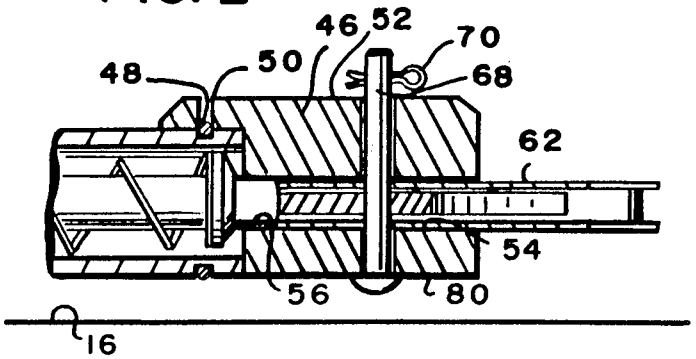
FIG. 2 is a reduced fragmentary side elevational view of the valve illustrated in FIG. 1 and taken generally about on lines 2—2 of FIG. 3.

From a review of FIGS. 1 and 2, it will be appreciated that valve 10 is mounted directly adjacent hull bottom 16 and that the linear movement of the cable actuator is normal to the axis of the valve, i.e., in a direction transverse of the boat. To enable the valve to lie as close to the hull bottom as possible, the underside of cap 46 may be provided with a flat 80 (FIG. 2) so that the apertures in the valve sleeve 24 lie closely adjacent hull bottom 16.

Figure 3:
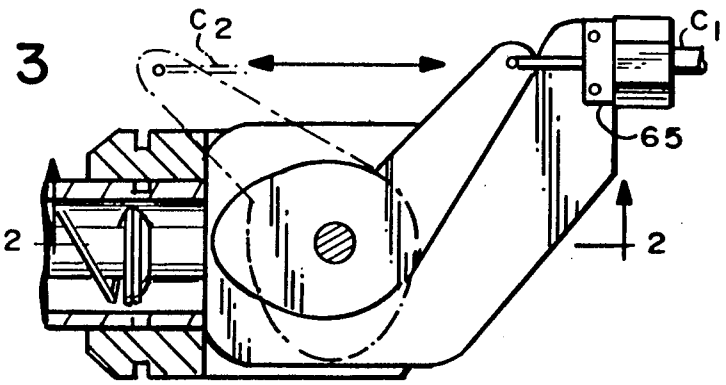
FIG. 3 is a reduced fragmentary plan view of the inner or cap end of the valve illustrating a reorientation of the cam actuator therefor for in-line actuation.

Referring now to FIG. 3, as stated previously, the cable actuator moves in a substantially linear direction generally normal to the axis of the valve when moving the cam between the dashed and full line illustration positions. It will be appreciated, however, that in certain applications, it is desirable to provide an in-line cable actuating movement, i.e., a linear cable actuating movement generally parallel to the axis of the valve. To accomplish this, cap 46 is removed from the sleeve 24 by removing spring clip 48. Pin 68 is then removed and cam 66 is reversed in position relative to the guide plates 62. When guide plates 62 are reinstalled in the slot 54, they are rotated to the position illustrated in FIG. 3 and pin 68 is inserted and secured by cotter pin 70. In this manner, cam 66 is aligned for actuation by an actuating cable movable linearly in the general direction of the axis of valve stem 34 as illustrated by the arrows in FIG. 3. This facilitates the cable routing in certain types of boats.

Figure 4:
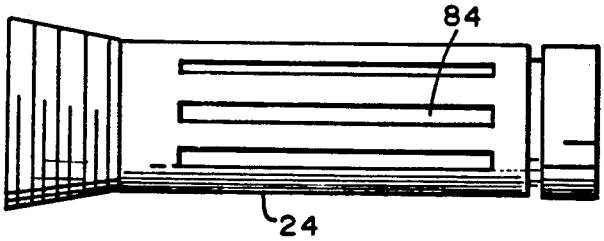
FIGS. 4, 5, 6 and 7 are reduced side elevational views of various configurations of the valve body.
Figure 6:
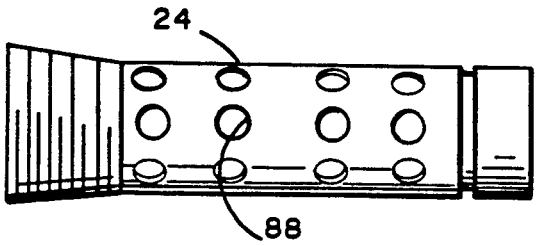
Figure 5:
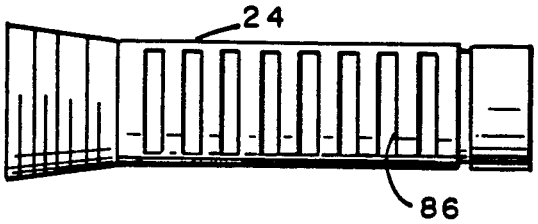
Figure 7:
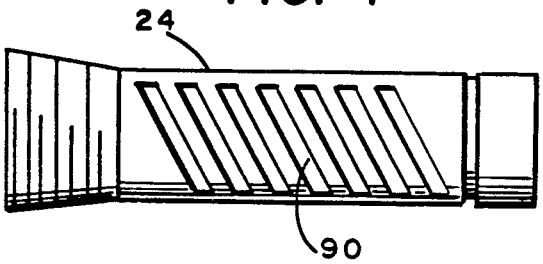
Figure 8:
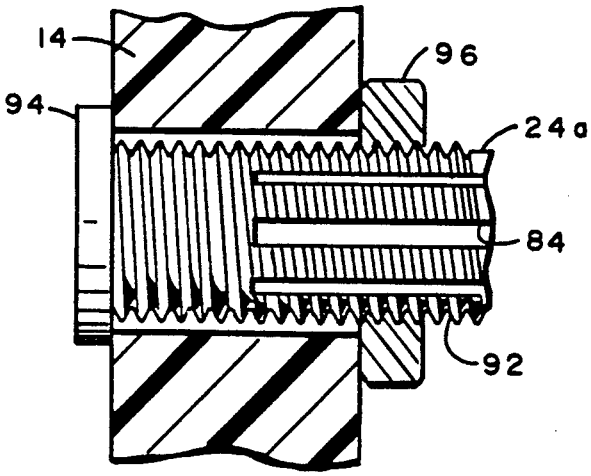
FIG. 8 is a fragmentary top plan view of a valve hereof illustrating a different form of mounting to the transom.

Referring now to FIGS. 4–7, it will be appreciated that various types of openings in the sleeve 24 may be provided to enable bilge water to enter the valve and drain. In FIG. 4, a plurality of elongated slots 84 circumferentially spaced one from the other are provided sleeve 24. In FIG. 5, circumferentially extending slots 86 axially spaced one from the other may be provided. In FIG. 6, a plurality of openings 88 are both circumferentially and axially spaced one from the other along sleeve 24. In FIG. 7, diagonally extending arcuate slots 90 may be provided through sleeve 24. Other types of openings or slot arrangements will be readily apparent to those of ordinary skill in this art.

Referring now to FIG. 7, there is illustrated another form of mounting for a valve sleeve **24*a* in transom 14. In this form, valve sleeve 24*a* is externally threaded at 92 for a substantial portion of its length. The openings 84 through sleeve 24 may be of the type illustrated in FIG. 4, although other types may be used. Instead of terminating in an outwardly flared end, valve sleeve 24*a* terminates in a radially extending flange 94 for butting and sealing against t he outboard surface of transom 14. An O-ring seal may be disposed as desired between flange 94 and transom 14. A nut 96 is threaded on sleeve 24*a* to clamp sleeve 24*a* to transom 14. It will be appreciated that the slots 84 in sleeve 24*a*** lie in communication with bilge water in the pump, enabling the water to drain from the boat.

The valve hereof may be formed of various types of materials. Preferably, the valve is formed of materials compatible for use in the environment contemplated. For example, the sleeve may be formed of stainless steel. The cam and valve stem may be formed of a plastic material, such as PVC. The valve stem, however, is preferably formed of Delrin.

An emergency disconnect between the cable and the cam may be provided to allow the valve to be operated in case of cable or actuator damage. Such disconnect may comprise a removable connector between the cable and cam, for example, a hairpin-shaped spring interconnecting the cam and the cable may be used. Upon disconnection, the valve can then be manually closed or opened as desired without the use of the cable.

Figure 9:
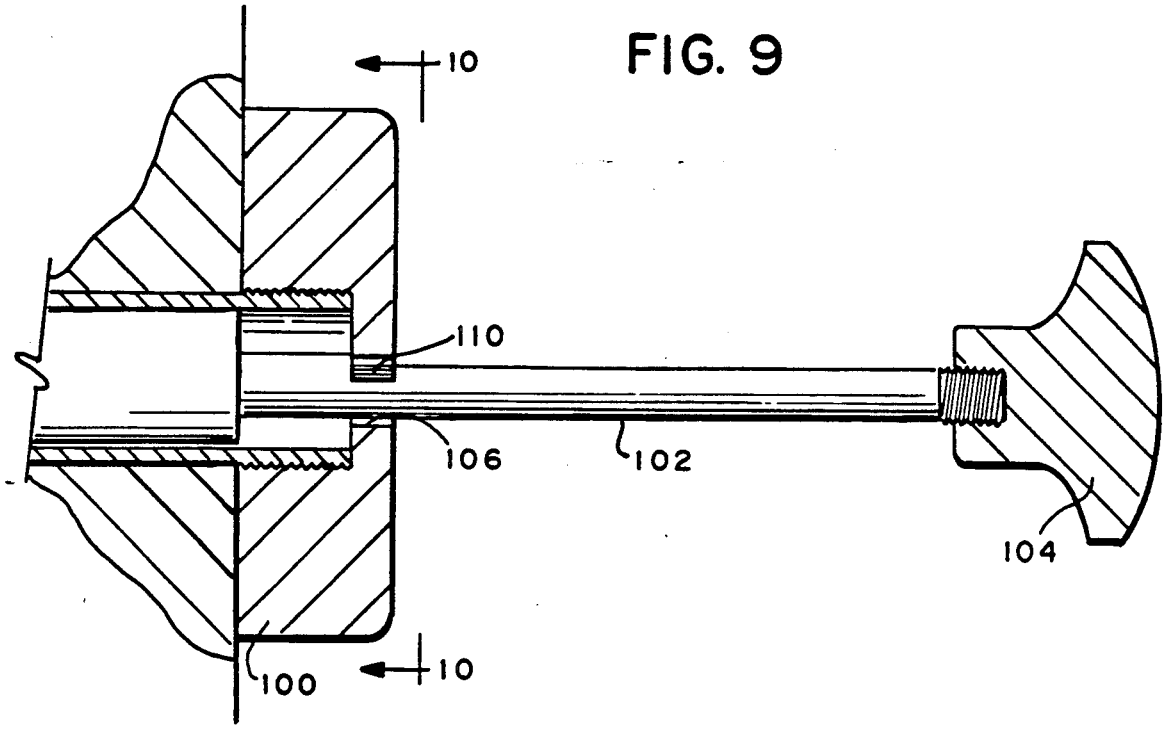
FIG. 9 is a side elevational view of the control for the valve hereof.
Figure 10:
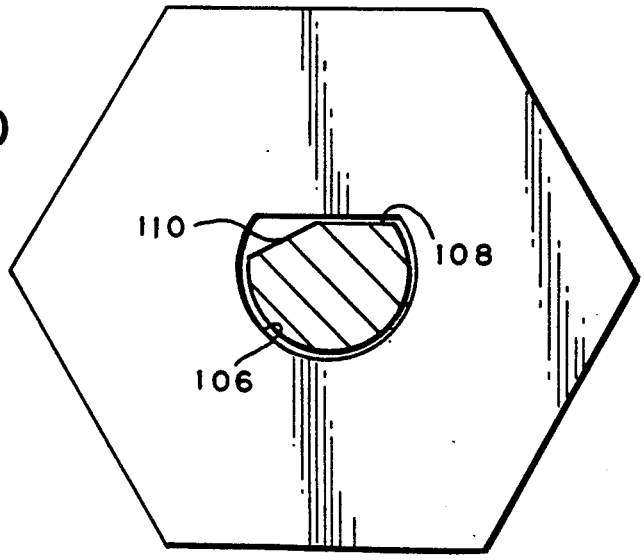
FIG. 10 is a cross-sectional view thereof taken generally about on line 10—10 in FIG. 9.

Another feature of the present invention resides in a lock-open feature for the valve actuator hereof. To accomplish this and referring now to FIGS. 9–10, the valve actuator at the boat dash, includes a nut 100 mounting a shaft 102 to which is connected the actuator knob 104. The shaft 102 is, of course, connected by conventional means, not shown, to the actuator cable. The nut is provided with a D-shaped opening 106 having a flat 108. A notch 110 is cut in the shaft, the shaft being otherwise milled flat to form a D-shaped cross-section to fit the D-shaped hole in the nut. Consequently, when the knob has been pulled from the dash sufficient to open the valve, the shaft 102 may be rotated to engage the notch 110 with the nut about the D-shaped opening, thereby locking the control knob in the valve open position. It will be appreciated that rotating the shaft in the opposite direction aligns the D-shaped shaft with the D-shaped opening in the nut, thereby permitting release of the knob and return of the valve to its closed position.

Accordingly, it will be appreciated that the objects of the present invention are fully accomplished in that there has been provided a remotely operated cam-actuated valve for mounting in the transom of a boat which has a versatility enabling the valve to accommodate various actuating cable orientations. For example, in FIG. 1, the cable orientation provides for a push-pull linear movement of the cable in a direction transverse to the boat, i.e., parallel to the transom. In the arrangement of FIG. 3, the linear push-pull direction of the actuator cable generally parallels the axis of the valve. The valve is thus readily and easily configured to accommodate either one of these directions of actuation. Additionally, the valve is formed of relatively inexpensive materials and may be readily and easily installed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a boat having a hull with a port through said hull, a valve carried by said boat providing for selective fluid communication through said port, including a valve sleeve having an axis and a valve seat, a valve head for sealing engagement with said seat and a stem projecting from said valve head within said valve sleeve;

means cooperable between said valve stem and said valve sleeve for biasing said valve stem in a direction urging said valve head into a valve-closed position, with said valve head in sealing engagement with said valve seat;

a mounting member secured on said valve sleeve at an end thereof remote from said seat, said member having a centrally located slot;

a cam carried by said member in said slot for pivotal movement and having camming surfaces and an actuating arm, said member having an opening through its inner end, enabling engagement of said camming surfaces with the end of said stem remote from said member;

means for pivoting said cam between valve-open and valve-closed positions, including an actuator connected to said arm and movable in a substantially linear direction; and means for releasably securing said cam relative to said member in either of two positions, said cam in a first position thereof being secured to said member for pivotal movement between valve-open and valve-closed positions in response to linear movement of said actuator in a direction generally parallel to the axis of said sleeve, said cam in a second position thereof being mounted for pivotal movement between valve-open and valve-closed positions in response to linear movement of said actuator in a direction generally normal to the axis of said sleeve.

2. Apparatus according to claim 1 including means carried by said cap for guiding said cam.

3. Apparatus according to claim 2 wherein said guide means includes a pair of laterally spaced guide plates, said cam being mounted for pivotal movement between said plates.

4. Apparatus according to claim 3 wherein said actuator includes a cable slidable within a fixed cable, and means carried by said guide plates for mounting said fixed cable in either of said two positions.

5. Apparatus according to claim 1 wherein said valve sleeve is externally threaded adjacent one end thereof, and an internally threaded coupling secured to said hull for threadedly receiving the sleeve.

6. Apparatus according to claim 1 wherein said valve sleeve includes a radially outwardly directed flange for engaging along one side of said hull, said sleeve being at least partly externally threaded, and a nut threadedly engaged along said sleeve for engaging the opposite side of said hull to secure the valve sleeve to the hull.

7. Apparatus according to claim 1 wherein said valve seat lies adjacent to and faces one end of said sleeve, said valve head having a larger diameter than the internal diameter of said sleeve for engaging said valve seat, said biasing means including a helical spring about said stem, said sleeve and said stem having abutments for sealing opposite ends of said spring with said sleeve abutment lying closer to said one end of said sleeve than said stem abutment whereby said spring biases said valve toward a valve-closed position.

8. Apparatus according to claim 1 including a plurality of radially extending projections carried on one of the interior surfaces of said sleeve or said stem and engageable with the other of said interior sleeve surfaces or said stem to maintain said stem substantially centered within said sleeve during operation.

9. In a boat having a transom, a valve providing for fluid communication through said transom, including a valve sleeve having an axis and a valve seat, a valve including a head for sealing engagement with said seat and a stem projecting from said head and within said valve sleeve;

means cooperable between said valve stem and said valve sleeve for biasing said valve stem in a direction urging said valve head into a valve-closed position, with said head in sealing engagement with said valve seat;

said valve sleeve having a plurality of openings therethrough enabling ingress of fluid from the boat into said valve sleeve;

a cap secured on said valve sleeve adjacent an end thereof remote from said seat;

a cam carried by said cap for pivotal movement relative to and engageable with a cam follower on the end of said stem remote from said head;

said cam having a cam surface and being pivotal into a first position to displace said stem against the bias of said biasing means into a valve-open position, with the valve head disengaged from said seat; and a plurality of radially extending projections carried on one of the interior surfaces of said sleeve or said stem and engageable with the other of said interior sleeve surfaces or said stem to maintain said stem substantially centered within said sleeve during operation.

10. Apparatus according to claim 9 including means for releasably securing said cap and said sleeve one to the other, including grooves for said cap and said sleeve and means interconnecting said grooves to releasably interconnect said cap and said sleeve.

11. Apparatus according to claim 10 including means carried by said cap for guiding said cam.

12. Apparatus according to claim 11 wherein said guide means includes a pair of laterally spaced guide plates, said cam being mounted for pivotal movement between said plates.

13. Apparatus according to claim 10 wherein said cap includes a centrally located slot, said cam being pivotally mounted in said slot and having camming surfaces, said cap having an opening through its inner end enabling engagement of said camming surfaces and said cam follower on said stem through said opening.

14. Apparatus according to claim 13 including means carried by said cap for guiding said cam, said guiding means including a pair of laterally spaced guide plates disposed in said slot, said cam being mounted for pivotal movement between said plates.

15. Apparatus according to claim 9 wherein said valve sleeve is externally threaded adjacent one end thereof, and an internally threaded coupling secured to said hull for threadedly receiving the sleeve.

16. Apparatus according to claim 9 wherein said valve sleeve includes a radially outwardly directed flange for engaging along one side of said hull, said sleeve being at least partly externally threaded, and a nut threadedly engaged along said sleeve for engaging the opposite side of said hull to secure the valve sleeve to the hull.

17. Apparatus according to claim 9 wherein said valve seat lies adjacent to and faces one end of said sleeve, said valve head having a larger diameter than the internal diameter of said sleeve for engaging said valve seat, said biasing means including a helical spring about said stem, said sleeve and said stem having abutments for sealing opposite ends of said spring with said sleeve abutment lying closer to said one end of said sleeve than said stem abutment whereby said spring biases said valve toward a valve-closed position.

18. Apparatus according to claim 9 including means for locking the valve in said valve open position.

19. Apparatus according to claim 9 wherein said sleeve openings are axially spaced one from the other.

20. Apparatus according to claim 9 wherein said sleeve openings are circumferentially spaced one from the other.

21. Apparatus according to claim 10 wherein said interconnecting means includes a spring clip releasably engageable in said grooves to facilitate separation of said cap and said sleeve one from the other.

* * * * *